US006474787B2

(12) United States Patent
Cruz-Uribe

(10) Patent No.: US 6,474,787 B2
(45) Date of Patent: Nov. 5, 2002

(54) FLEXTENSIONAL TRANSDUCER

(75) Inventor: Antonio S Cruz-Uribe, Corvallis, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/814,254

(22) Filed: Mar. 21, 2001

(65) Prior Publication Data

US 2002/0135639 A1 Sep. 26, 2002

(51) Int. Cl.[7] ..... B41J 2/04
(52) U.S. Cl. ..... 347/54
(58) Field of Search ..... 347/54, 68, 69, 347/70, 71, 72, 50, 40, 20, 44, 47, 27, 63; 399/261; 361/700; 310/328–330; 29/890.1

(56) References Cited

U.S. PATENT DOCUMENTS

| | | | |
|---|---|---|---|
| 4,533,082 | A | 8/1985 | Maehara et al. |
| 4,605,167 | A | 8/1986 | Maehara |
| 5,152,456 | A | 10/1992 | Ross et al. |
| 5,255,016 | A | 10/1993 | Usui et al. |
| 5,518,179 | A | 5/1996 | Humberstone et al. |
| 5,828,394 | A | 10/1998 | Khuri-Yakub et al. |
| 6,291,927 | B1 | 9/2001 | Percin et al. |

FOREIGN PATENT DOCUMENTS

| | | |
|---|---|---|
| EP | 0655334 A1 | 5/1995 |
| WO | WO 93/01404 | 1/1983 |
| WO | WO 93/10910 | 6/1993 |
| WO | WO 97/12689 | 4/1997 |
| WO | WO 01/62394 | 8/2001 |

OTHER PUBLICATIONS

Percin et al., Micromachined 2–D Array Piezoelectrically Actuated Flextensional Transducers and Inkjet Print Heads. Electrochemical Society Proceedings vol. 98–14, pp. 87–93.

Percin et al., Resist Deposition without Spinning by Using Novel Inkjet Technology and Direct Lithography for MEMS. SPIE vol. 3333, pp. 1382–1389.

Percin, G., Micromachined Piezoelectrically Actuated Flextensional Transducers for High Resolution Printing and Medical Imaging, 1999, pp. 1–23.

Percin et al., Micromachined 2–D Array Piezoelectrically Actuated Flextensional Transducers: New Designs. Part of the SPIE Conference on Micromachined Devices and Components IV, Santa Clara, California, Sep. 1998; SPIE vol. 3514, pp. 411–414.

Percin et al., Controlled Ink–Jet Printing and Deposition of Organic Polymers and Solid Particles. Applied Physics Letters, vol. 73, No. 16, Oct. 19, 1998, pp. 2375–2377.

Percin et al., Micromachined Two–Dimensional Array Piezoelectrically Actuated Transducers. Applied Physics Letters, vol. 72, No. 11, Mar. 16, 1998, pp. 1397–1399.

(List continued on next page.)

*Primary Examiner*—Raquel Yvette Gordon

(57) ABSTRACT

A flextensional transducer adapted to eject droplets of a fluid includes a substrate having a fluid cavity defined therein, a flexible membrane portion supported by the substrate, and an actuator associated with the flexible membrane portion. The flexible membrane portion has spaced edges and an orifice defined therein which communicates with the fluid cavity. The actuator is adapted to deflect the flexible membrane portion to eject droplets of fluid through the orifice in response to an electrical signal applied to the actuator.

39 Claims, 11 Drawing Sheets

OTHER PUBLICATIONS

Percin et al., Piezoelectrically Actuated Transducer and Droplet Ejector. 1996 IEEE Ultrasonics Symposium, pp. 913–916.

Percin et al., Piezoelectrically Actuated Droplet Ejector. Review of Scientific Instruments, vol. 68, No. 12, Dec. 1997, pp. 4561–4563.

Percin et al., Micromachined 2–D Array Piezoelectrically Actuated Flextensional Transducers. 1997 IEEE Ultrasonics Symposium, pp. 959–962.

Percin et al., Micromachined 2–D Array Piezoelectrically Actuated Flextensional Transducers and Inkjet Print Heads. Electrochemical Society Proceedings vol. 98–14, pp. 87–93.

Percin et al., Resist Deposition without Spinning by Using Novel Inkjet Technology and Direct Lithography for MEMS. SPIE vol. 3333, pp. 1382–1389.

Percin, G., Micromachined Piezoelectrically Actuated Flextensional Transducers for High Resolution Printing and Medical Imaging, 1999, pp. 1–23.

FLEXTENSIONAL TRANSDUCER

CROSS-REFERENCE TO RELATED APPLICATIONS

This application is related to U.S. patent application Ser. No. 09/814,274 entitled "Flextensional Transducer Assembly Including Array of Flextensional Transducers" filed on even date herewith, assigned to the assignee of the present invention, and incorporated herein by reference.

THE FIELD OF THE INVENTION

The present invention relates generally to fluid drop ejectors, and more particularly to a flextensional transducer for ejecting droplets of a flowable material.

BACKGROUND OF THE INVENTION

Fluid drop ejectors have been developed for ejecting droplets of a flowable material in a controlled manner. An example of a fluid drop ejector includes a flextensional transducer. As illustrated in FIGS. 1A and 1B, a conventional flextensional transducer 90 includes a cylindrical body 92, a circular flexible membrane 94 having an orifice 96 defined therein, and an annular actuator 98. The cylindrical body defines a reservoir for holding a supply of flowable material and the circular flexible membrane has a circumferential edge clamped to the cylindrical body. The annular actuator includes a piezoelectric material which deforms when an electrical voltage is applied. As such, when the piezoelectric material deforms, the circular flexible membrane deflects causing a quantity of flowable material to be ejected through the orifice from the reservoir.

One application of a flextensional transducer is in an inkjet printing system. As such, the inkjet printing system includes a printhead including a plurality of flextensional transducers which eject droplets of ink through orifices or nozzles to form an image on a print medium. One way to improve a quality of the image is to increase the resolution of the image. Resolution of the image is measured in dots-per-inch. To increase the resolution, therefore, the number of dots per inch must increase. Accordingly, the number of drops per inch must increase.

One way to increase the number of drops per inch is to increase the number of orifices or nozzles per unit of area of the printhead. Thus, a density of the flextensional transducers which eject the drops must increase. Therefore, for a fixed drop size, a spacing between the flextensional transducers and, more specifically, a spacing between the orifices or nozzles must decrease. Since the conventional flextensional transducer is cylindrical in shape, an arrangement of and/or spacing between the flextensional transducers is restricted by the cylindrical shape. Thus, increasing the density of a plurality of conventional flextensional transducers is limited.

Accordingly, a need exists for a flextensional transducer which provides greater flexibility in a design of an individual flextensional transducer as well as an arrangement of a plurality of flextensional transducers. More particularly, a need exists for a flextensional transducer which enables a compact array and, therefore, a greater density of orifices of a plurality of flextensional transducers.

SUMMARY OF THE INVENTION

One aspect of the present invention provides a flextensional transducer. The flextensional transducer includes a substrate having a fluid cavity defined therein, a flexible membrane portion supported by the substrate, and an actuator associated with the flexible membrane portion. The flexible membrane portion has a pair of spaced edges and an orifice defined therein which communicates with the fluid cavity. As such, the actuator is adapted to deflect the flexible membrane portion in response to an electrical signal.

In one embodiment, the fluid cavity is adapted to hold a supply of fluid therein such that the fluid communicates with the orifice of the flexible membrane portion. In one embodiment, the orifice of the flexible membrane portion defines a nozzle adapted to eject a quantity of the fluid in response to deflection of the flexible membrane portion.

In one embodiment, the pair of spaced edges of the flexible membrane portion are substantially linear. In one embodiment, the pair of spaced edges of the flexible membrane portion are curved.

In one embodiment, the fluid cavity has opposing sides and the pair of spaced edges of the flexible membrane portion follow the opposing sides of the fluid cavity. In one embodiment, the substrate includes opposing sidewalls which define opposing sides of the fluid cavity. In one embodiment, the sidewalls of the substrate are substantially linear. In one embodiment, the sidewalls of the substrate are curved. In one embodiment, the pair of spaced edges of the flexible membrane portion are positioned within the sidewalls of the substrate.

In one embodiment, the pair of spaced edges of the flexible membrane portion are formed by a pair of spaced slits in the flexible membrane portion. In one embodiment, the pair of spaced slits include spaced cuts through the flexible membrane portion. In one embodiment, the pair of spaced slits include spaced channels in the flexible membrane portion.

In one embodiment, the flexible membrane portion has an edge extending between the pair of spaced edges thereof. In one embodiment, the edge of the flexible membrane portion is oriented substantially perpendicular to the pair of spaced edges thereof. In one embodiment, the edge of the flexible membrane portion is formed by a slit in the flexible membrane portion.

In one embodiment, the flexible membrane portion is cantilevered over the fluid cavity. In one embodiment, the flexible membrane portion has a plurality of orifices defined therein.

In one embodiment, the actuator is provided on a side of the flexible membrane portion and positioned between the orifice and a supported end of the flexible membrane portion. In one embodiment, the actuator includes a first actuator and a second actuator such that the orifice is located between the first actuator and the second actuator. In one embodiment, the actuator includes a piezoelectric material.

Another aspect of the present invention provides a method of forming a flextensional transducer. The method includes defining a fluid cavity in a substrate, supporting a flexible membrane portion by the substrate, defining a pair of spaced edges of the flexible membrane portion, communicating an orifice of the flexible membrane portion with the fluid cavity, and associating an actuator with the flexible membrane portion. As such, the actuator is adapted to deflect the flexible membrane portion in response to an electrical signal.

Another aspect of the present invention provides a method of ejecting droplets of a fluid. The method includes supplying a fluid cavity with the fluid, extending a flexible membrane portion having a pair of spaced edges and an orifice defined therein over the fluid cavity such that the orifice communicates with the fluid cavity, and deflecting the flexible membrane portion relative to the fluid cavity to eject a quantity of the fluid through the orifice of the flexible membrane portion when the flexible membrane portion deflects.

Another aspect of the present invention provides a flextensional transducer. The flextensional transducer includes a substrate having a fluid cavity defined therein, a flexible membrane portion supported by the substrate and having an orifice defined therein which communicates with the fluid cavity, an actuator associated with the flexible membrane portion, and a compliant feature adjacent the actuator. The actuator is adapted to deflect the flexible membrane portion in response to an electrical signal. As such, the compliant feature facilitates deflection of the flexible membrane portion.

The present invention provides a flextensional transducer adapted to eject droplets of a fluid in a controlled manner. The flextensional transducer includes an actuator which deflects a flexible membrane portion in response to an electrical signal. The flexible membrane portion has spaced edges and an orifice defined therein such that deflection of the flexible membrane portion causes ejection of fluid from a fluid cavity and through the orifice. In addition, the present invention provides a flextensional transducer assembly which includes a plurality of flextensional transducers arranged in an array.

DESCRIPTION OF THE PREFERRED EMBODIMENTS

Figure 1A:
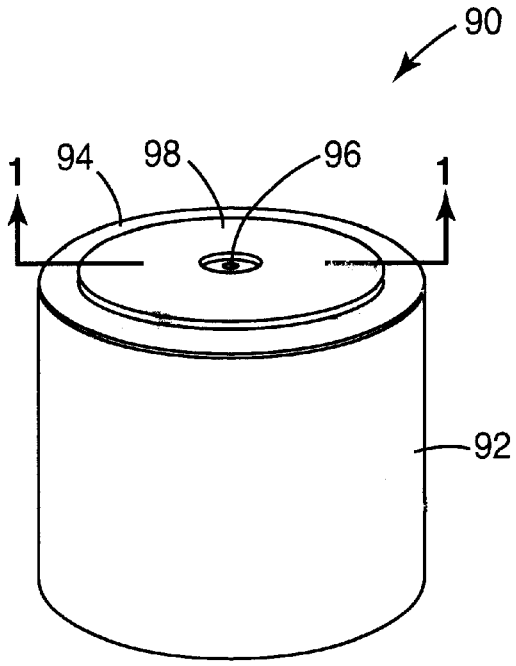
Fig. 1A PRIOR ART
FIG. 1A is a perspective view of a portion of a prior art flextensional transducer.

In the following detailed description of the preferred embodiments, reference is made to the accompanying drawings which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Since components of the present invention can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

FIGS. 2–5 illustrate one embodiment of a flextensional transducer 10. Flextensional transducer 10 is a fluid drop ejection device which eject droplets of a flowable material. Flextensional transducer 10 may include drop-on-demand and/or continuous modes of operation. In one embodiment, as described below, a plurality of flextensional transducers 10 are arranged to form an array of flextensional transducers. For clarity, the following description refers to the ejection of fluid from flextensional transducer 10. Fluid, as used herein, is defined to include any flowable material, including a liquid such as water, ink, blood, or photoresist and flowable particles of a solid such as talcum powder.

In one embodiment, flextensional transducer 10 includes a supporting structure or substrate 20, a flexible membrane portion 30, and an actuator 40. Substrate 20 has a fluid cavity 21 formed therein which communicates with a supply of fluid for flextensional transducer 10. Substrate 20 includes opposing sidewalls 22 which define opposing sides 23 of fluid cavity 21. In one embodiment, fluid cavity 21 is substantially rectangular in shape. As such, opposing sidewalls 22 of substrate 20 are substantially linear sidewalls. In addition, opposing sidewalls 22 are substantially parallel and define substantially parallel opposing sides of fluid cavity 21.

Flexible membrane portion 30 extends across or over fluid cavity 21 such that fluid cavity 21 and flexible membrane portion 30 define a fluid reservoir 24. As such, fluid reservoir 24 holds or contains fluid for flextensional transducer 10. As described below, deflection of flexible membrane portion 30 causes ejection of fluid from fluid reservoir 24. Thus, fluid reservoir 24 need not be pressurized by the operation of flextensional transducer 10. In addition, it is not necessary to completely seal fluid reservoir 24 for operation of flextensional transducer 10.

Flexible membrane portion 30 has an orifice 31 defined therein which communicates with fluid cavity 21. As such, when fluid cavity 21 is supplied with fluid, the fluid communicates with orifice 31. Flexible membrane portion 30 includes an axis 32 and a pair of spaced edges 33. In addition, orifice 31 has an axis 34 oriented substantially perpendicular to axis 32 of flexible membrane portion 30. Orifice 31 defines a nozzle for ejecting a quantity of fluid from fluid cavity 21 in response to deflection of flexible membrane portion 30, as described below.

Flexible membrane portion 30 is formed of a flexible material such as, for example, a flexible thin layer of silicon or a flexible thin film of silicon nitride or silicon carbide. In one embodiment, substrate 20 and flexible membrane portion 30 are formed of a homogeneous material such as, for example, silicon. As such, flexible membrane portion 30 is formed by a flexible thin layer of silicon extending across fluid cavity 21.

Figure 2:
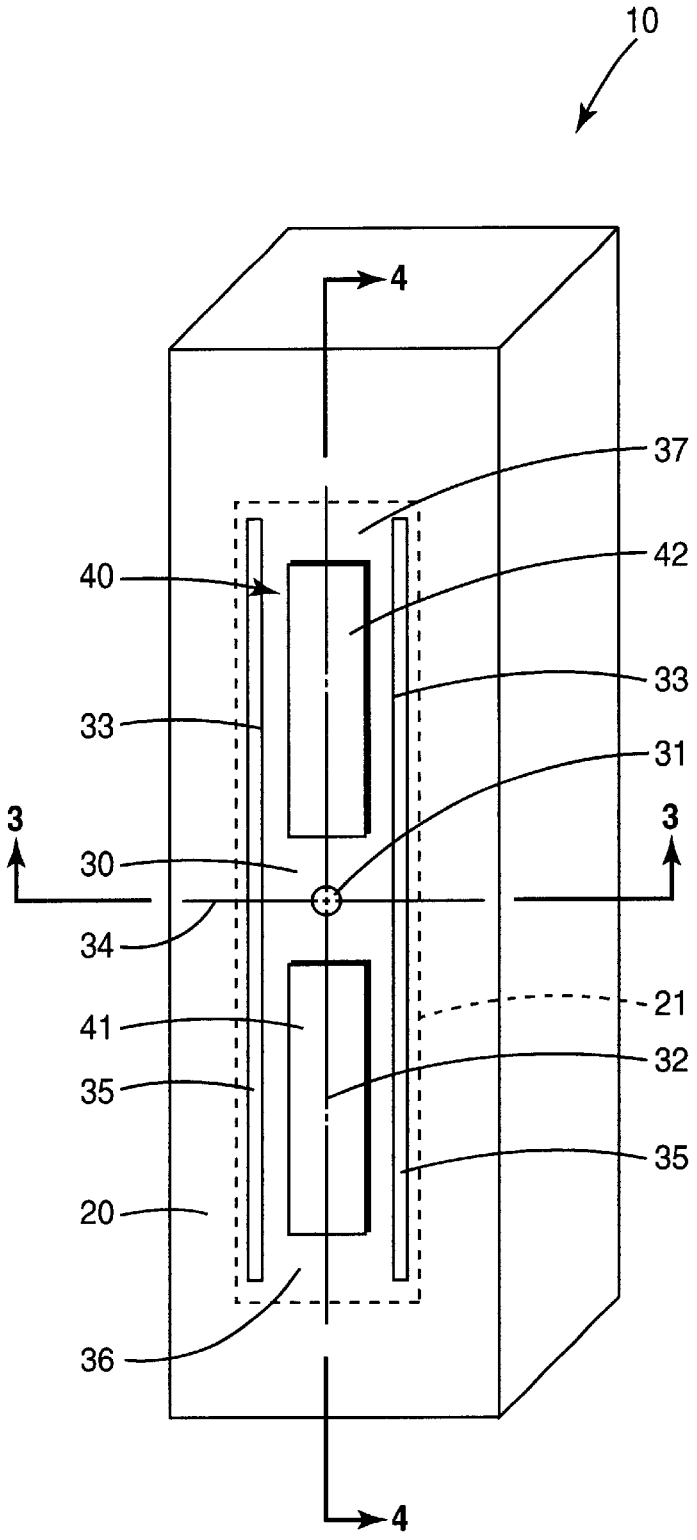
FIG. 2 is a perspective view of one embodiment of a portion of a flextensional transducer according to the present invention.

In one embodiment, as illustrated in FIG. 2, spaced edges 33 of flexible membrane portion 30 are substantially linear. More specifically, spaced edges 33 are substantially parallel and are oriented substantially parallel with axis 32. As such, flexible membrane portion 30 is substantially rectangular in shape. In addition, opposing sides 23 of fluid cavity 21 are substantially linear. Spaced edges 33 of flexible membrane portion 30, therefore, track or follow the contour of opposing sides 23 of fluid cavity 21. As such, spaced edges 33 of flexible membrane portion 30 are oriented substantially parallel with and positioned, in plan view, within opposing sides 23 of fluid cavity 21.

In one embodiment, spaced edges 33 of flexible membrane portion 30 are formed by a pair of spaced slits 35 in flexible membrane portion 30. In one embodiment, slits 35 are substantially parallel spaced slits which extend between opposite ends 36 and 37 of flexible membrane portion 30. Slits 35 permit flexible membrane portion 30 to deflect relative to substrate 20 and, therefore, fluid cavity 21.

Figure 3A:
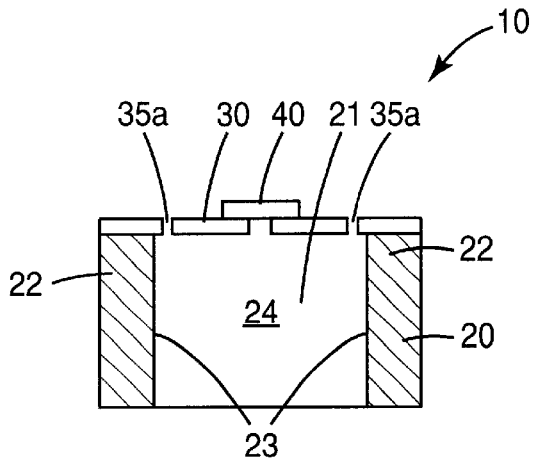
FIG. 3A is a cross-sectional view taken along line 3—3 of FIG. 2 illustrating one embodiment of the flextensional transducer.

In one embodiment, as illustrated in FIG. 3A, slits 35 are through-slits formed by spaced cuts 35*a* through flexible membrane portion 30. As such, cuts 35*a* may be sealed with a flexible material or thin film such as a polymer to prevent fluid within fluid cavity 21 from passing through cuts 35*a*. Cuts 35*a*, however, may be of a width which, based on a surface tension or particle size of the fluid within fluid cavity 21, prevents the fluid from passing through cuts 35*a*. Cuts 35*a*, for example, may be significantly narrower than a diameter of orifice 31 such that cuts 35*a* present greater resistance to flow than orifice 31.

Figure 3B:
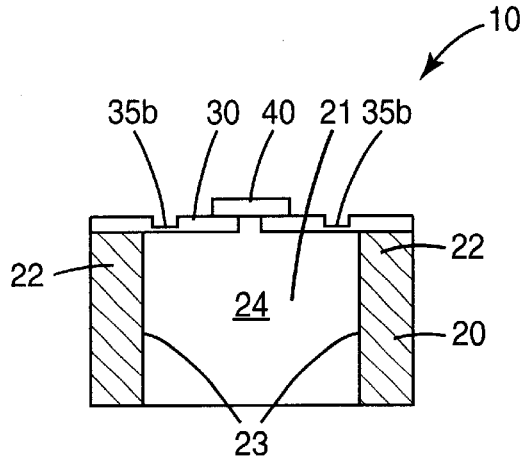
FIG. 3B is a cross-sectional view similar to FIG. 3A illustrating another embodiment of the flextensional transducer.
Figure 4:
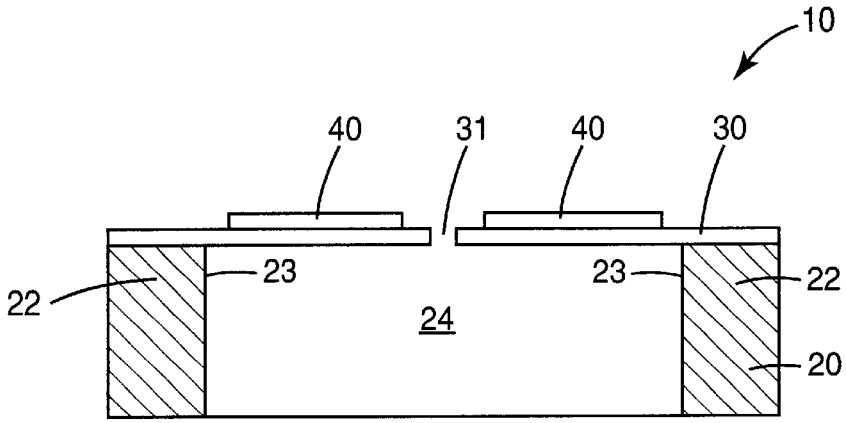
FIG. 4 is a cross-sectional view taken along line 4—4 of FIG. 2 illustrating one embodiment of the flextensional transducer.

In another embodiment, as illustrated in FIG. 3B, slits 35 are nonthrough-slits formed by spaced trenches or channels 35*b* in flexible membrane portion 30. As such, channels 35*b* form weakened areas of thinner material of flexible membrane portion 30. Channels 35*b* may be formed, for example, by reducing a thickness of portions of flexible membrane portion 30 such as by etching. To permit a desired deflection of flexible membrane portion 30 relative to substrate 20, channels 35*b* may be wider than cuts 35*a* such that added flexibility is achieved along channels 35*b*.

With spaced edges 33 of flexible membrane portion 30 being formed by slits 35 in flexible membrane portion 30, flexible membrane portion 30 includes a portion extending between spaced edges 33 and portions provided laterally of spaced edges 33. Outer edges of slits 35, however, may be aligned with opposing sides 23 of fluid cavity 21 such that portions of flexible membrane portion 30 provided laterally of spaced edges 33 are minimized. In addition, slits 35 may be formed by gaps provided along spaced edges 33 of flexible membrane portion 30.

In one embodiment, opposite ends 36 and 37 of flexible membrane portion 30 are both supported by substrate 20. More specifically, ends 36 and 37 are affixed to sidewalls 22 of substrate 20. Thus, flexible membrane portion 30 forms a beam which is clamped or fixed to substrate 20 at ends 36 and 37. Ends 36 and 37, therefore, constitute supported and/or clamped ends of flexible membrane portion 30 and spaced edges 33 constitute unsupported edges of flexible membrane portion 30 as formed, for example, by slits 35. Thus, spaced edges 33 are not supported by substrate 20. Flexible membrane portion 30, therefore, is supported on less than all sides. As such, slits 35 permit deflection of flexible membrane portion 30 relative to substrate 20, as described below. With both ends 36 and 37 of flexible membrane portion 30 being supported by substrate 20, a maximum deflection of flexible membrane portion 30 occurs at orifice 31 during a symmetric deflection mode.

Actuator 40 is associated with and causes deflection of flexible membrane portion 30. In one embodiment, actuator 40 is provided and, more specifically, mounted or formed on a side of flexible membrane portion 30 opposite fluid cavity 21. As such, actuator 40 is not in direct contact with fluid contained within fluid cavity 21. Thus, any potential effects of fluid contacting actuator 40, such as corrosion or electrical shorting, are avoided. While actuator 40 is illustrated as being provided on a side of flexible membrane portion 30 opposite fluid cavity 21, it is also within the scope of the present invention for actuator 40 to be provided on a side of flexible membrane portion 30 facing fluid cavity 21.

In one embodiment, actuator 40 includes a first actuator 41 and a second actuator 42. First actuator 41 and second actuator 42 are both mounted or formed on one side of flexible membrane portion 30 opposite fluid cavity 21. In addition, orifice 31 is located between first actuator 41 and second actuator 42. As such, first actuator 41 and second actuator 42 are positioned on opposite sides of orifice 31. More specifically, first actuator 41 and second actuator 42 are positioned along axis 32 and between ends 36 and 37, respectively, and orifice 31 of flexible membrane portion 30.

In one embodiment, actuator 40 includes a piezoelectric material which changes shape, for example, expands and/or contracts, in response to an electrical signal. Preferably, actuator 40 expands and/or contracts in a direction along axis 32 of flexible membrane portion 30. Thus, in response to the electrical signal, actuator 40 applies a force to flexible membrane portion 30 which causes flexible membrane portion 30 to deflect. As such, orifice 31 is located in an area of flexible membrane portion 30 which achieves maximum deflection when flexible membrane portion 30 deflects. Examples of a piezoelectric material include zinc oxide or a piezoceramic material such as barium titanate, lead zirconium titanate (PZT), or lead lanthanum zirconium titanate (PLZT). It is understood that actuator 40 may include any type of device which causes movement or deflection of flexible membrane portion 30 including an electrostatic, magnetostatic, and/or thermal expansion actuator.

A compliant feature of flextensional transducer 10 facilitates deflection of flexible membrane portion 30 relative to substrate 20. Spaced edges 33 of flexible membrane portion 30 and spaced slits 35 in flexible membrane portion 30 constitute examples of the compliant feature of flextensional transducer 10. In one embodiment, the compliant feature of flextensional transducer 10 permits deflection of flexible membrane portion 30 in response to force applied by actuator 40. Accordingly, the compliant feature of flextensional transducer 10 is provided adjacent to actuator 40.

The compliant feature of flextensional transducer 10 may include a gap provided along edge 33 of flexible membrane portion 30 and/or a region or area of flexible membrane portion 30 which bends or gives way in response to force applied by actuator 40. The compliant feature of flextensional transducer 10, therefore, includes cuts 35*a* through flexible membrane portion 30 which form gaps along edges 33 of flexible membrane portion 30 as well as channels 35*b* in flexible membrane portion 30 which form elastic or supple regions of flexible membrane portion 30.

Figure 1B:
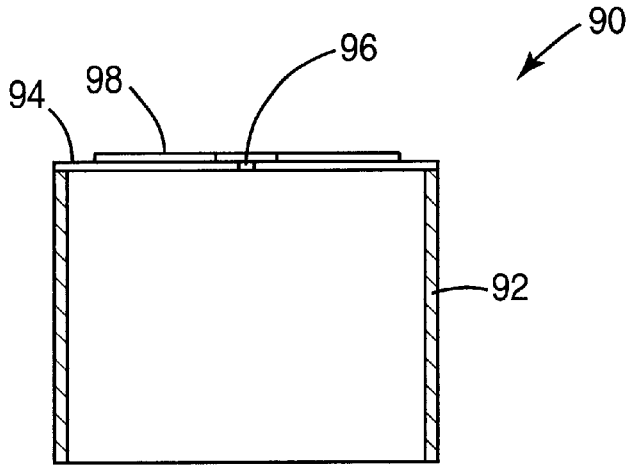
Fig. 1B PRIOR ART
FIG. 1B is a cross-sectional view taken along line 1—1 of FIG. 1A.
Figure 5:
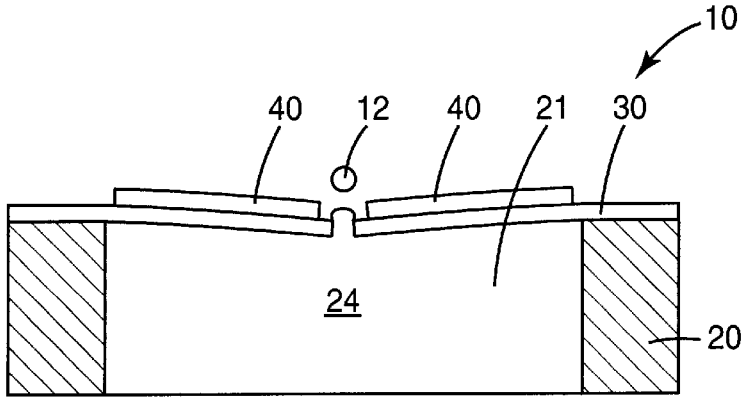
FIG. 5 is a cross-sectional view similar to FIG. 4 illustrating ejection of fluid from the flextensional transducer.

As illustrated in FIG. 5, when flexible membrane portion 30 deflects, a droplet 12 of fluid is formed and ejected from orifice 31 of flextensional transducer 10. Since flexible membrane portion 30 is supported or clamped on less than all sides, the force applied by actuator 40 causes greater displacement of flexible membrane portion 30 than circular flexible membrane 94 of comparable area of the conventional flextensional transducer 90 which is supported or clamped on all sides, as illustrated in FIGS. 1A and 1B. Accordingly, greater displacement of flexible membrane portion 30 results in a higher velocity of ejection of droplets through orifice 31. It is understood that the extent of deflection of flexible membrane portion 30 illustrated in FIG. 5 has been exaggerated for clarity of the invention.

Cyclical application of an electrical signal to actuator 40 causes flexible membrane portion 30 to oscillate. Flexible membrane portion 30 has a resonant frequency and, as such, may oscillate in different resonant vibrational modes. Preferably, flexible membrane portion 30 oscillates into a lowest order, symmetric resonant vibrational mode with maximum deflection occurring at orifice 31. Flextensional transducer 10, therefore, ejects droplets 12 of fluid at a predetermined rate and/or at predetermined intervals.

A frequency at which flexible membrane portion 30 oscillates is dependent on a material and size of flexible membrane portion 30. In one illustrative embodiment, with flexible membrane portion 30 supported at opposite ends 36 and 37, as illustrated, for example, in FIGS. 2 through 5, the following formula represents a relationship between a frequency of oscillation (f) of flexible membrane portion 30, a thickness (t) of flexible membrane portion 30, and a length (l) of flexible membrane portion 30 at a lowest order, symmetric resonant vibrational mode:

$$f=(7.6*10\hat{}3)t/l\hat{}2$$

(f(Hz), t(microns), l(mm))

Thickness (t) of flexible membrane portion 30 is measured in a direction normal to a surface of flexible membrane portion 30 and length (l) of flexible membrane portion 30 is measured along axis 32 of flexible membrane portion 30. As such, in the illustrative embodiment, the frequency of oscillation (f) of flexible membrane portion 30 is independent of a width of flexible membrane portion 30. It is understood that thickness (t) of flexible membrane portion 30 may be increased to increase a stiffness of and, therefore, vary a displacement of flexible membrane portion 30. Thus, different displacements may be designed to match, for example, a desired orifice size and/or drop velocity.

Figure 6:
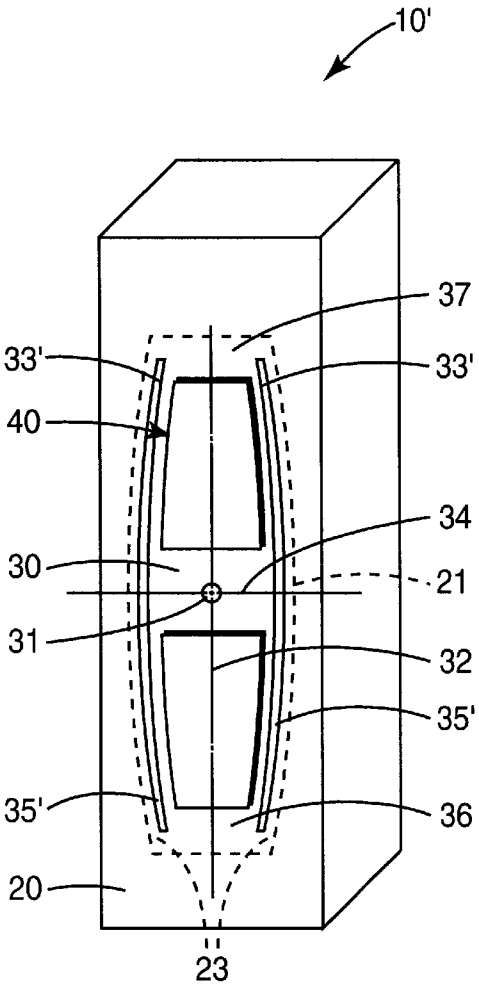
FIG. 6 is a perspective view illustrating another embodiment of the flextensional transducer of FIG. 2.

FIG. 6 illustrates another embodiment of flextensional transducer 10. Flextensional transducer 10' is similar to flextensional transducer 10, with the exception that flexible membrane portion 30 of flextensional transducer 10' includes spaced edges 33' which are bowed or curved. More specifically, spaced edges 33' converge at ends 36 and 37 of flexible membrane portion 30 and are substantially symmetrical about axis 32 and axis 34. As such, flexible membrane portion 30 is substantially elliptical in shape.

In addition, opposing sides 23 of fluid cavity 21 of flextensional transducer 10' are bowed or curved. Spaced edges 33' of flexible membrane portion 30, therefore, track opposing sides 23 of fluid cavity 21. As such, spaced edges 33' of flexible membrane portion 30 are positioned, in plan view, within opposing sides 23 of fluid cavity 21. Spaced edges 33' are formed by spaced slits 35' in a manner similar to that described above.

Figure 7:
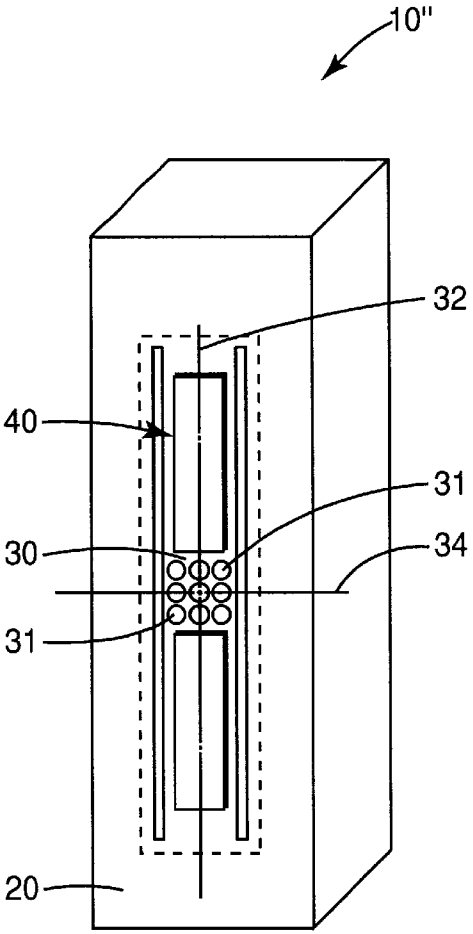
FIG. 7 is a perspective view illustrating another embodiment of the flextensional transducer of FIG. 2.

FIG. 7 illustrates another embodiment of flextensional transducer 10. Flextensional transducer 10" is similar to flextensional transducer 10, with the exception that flexible membrane portion 30 of flextensional transducer 10" has a plurality of orifices 31 formed therein. Thus, deflection of flexible membrane portion 30 by actuator 40 simultaneously generates a plurality of droplets. Preferably, orifices 31 are arranged in one or more rows along and/or about axis 34 and/or axis 32 of flextensional transducer 10". As such, orifices 31 are located in an area of flexible membrane portion 30 which achieves maximum deflection. It is understood that the number of orifices 31 and/or the number of rows of orifices 31 formed in flexible membrane portion 30 may vary.

Figure 8:
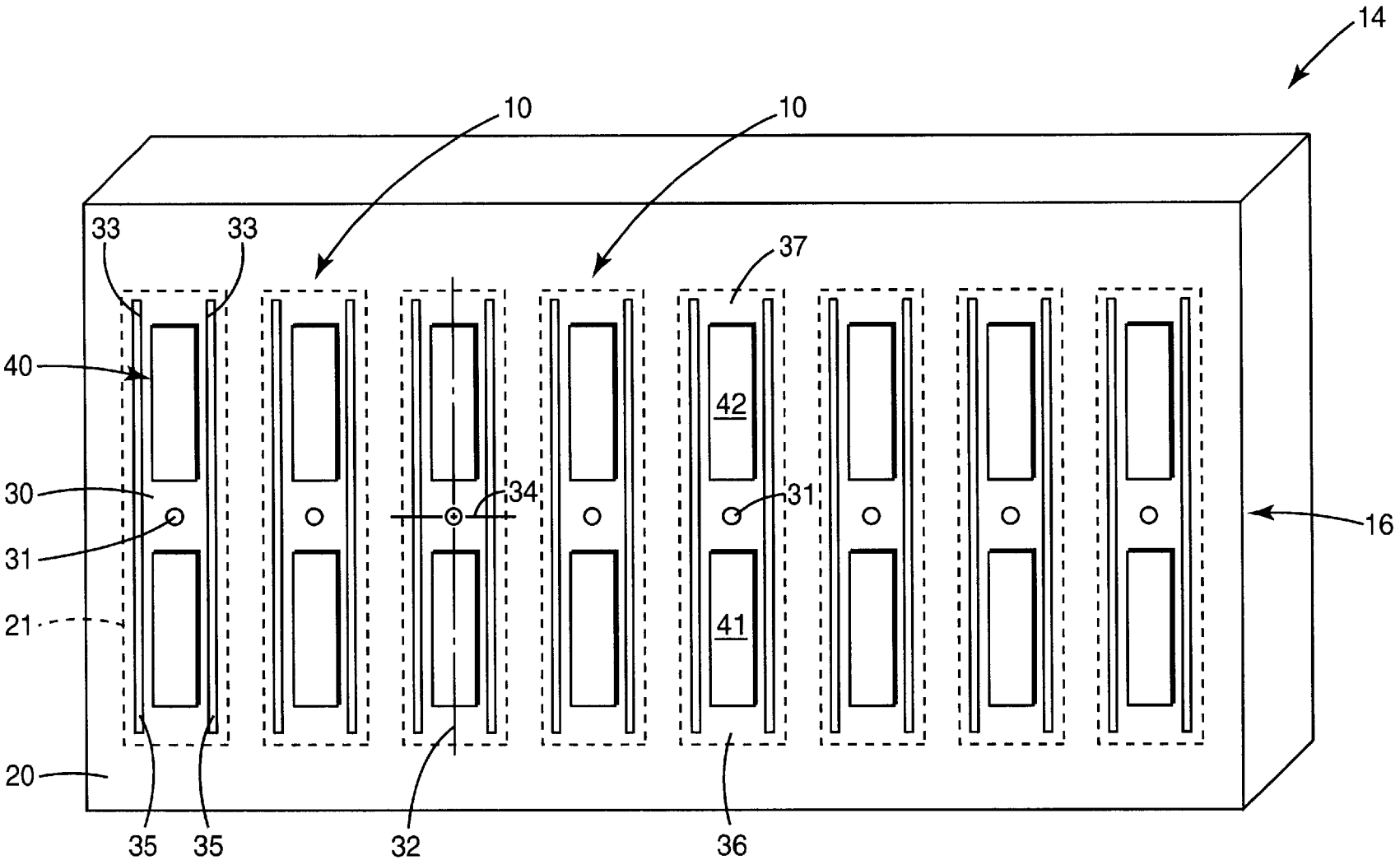
FIG. 8 is a perspective view of one embodiment of a portion of a flextensional transducer assembly according to the present invention including an array of flextensional transducers.

FIG. 8 illustrates one embodiment of a portion of a flextensional transducer assembly 14. Flextensional transducer assembly 14 forms a fluid drop ejection device and includes a plurality of flextensional transducers 10 which eject droplets of a flowable material. As such, flextensional transducer assembly 14 includes an array of flextensional transducers 10. Thus, in one embodiment, flextensional transducer assembly 14 includes substrate 20 which has a plurality of fluid cavities 21 defined therein, a plurality of flexible membrane portions 30 each supported by substrate 20, and a plurality of actuators 40. Each actuator 40 is associated with one flexible membrane portion 30 so as to deflect flexible membrane portion 30 and eject a droplet of fluid, as described above.

It is also within the scope of the present invention for individual flextensional transducers 10 to be ganged or grouped together to form an array of flextensional transducers 10. As such, flextensional transducers 10 do not share a common substrate 20. While only flextensional transducers 10 are illustrated as being arranged in an array, it is understood that flextensional transducer assembly 14 may include an array of flextensional transducers 10' or 10".

In one embodiment, flextensional transducers 10 of flextensional transducer assembly 14 are arranged in a linear array. As such, orifice 31 of one flextensional transducer 10 is aligned with orifice 31 of another and, more specifically, adjacent flextensional transducer 10. More specifically, axis 34 of one orifice 31 is aligned with axis 34 of an adjacent orifice 31. Thus, orifices 31 of adjacent flextensional transducers 10 form a row of orifices 16. While flextensional transducers 10 of flextensional transducer assembly 14 are illustrated as being arranged in a linear array, it is within the scope of the present invention for flextensional transducers 10 to be arranged in other arrays such as those described below.

Figure 9:
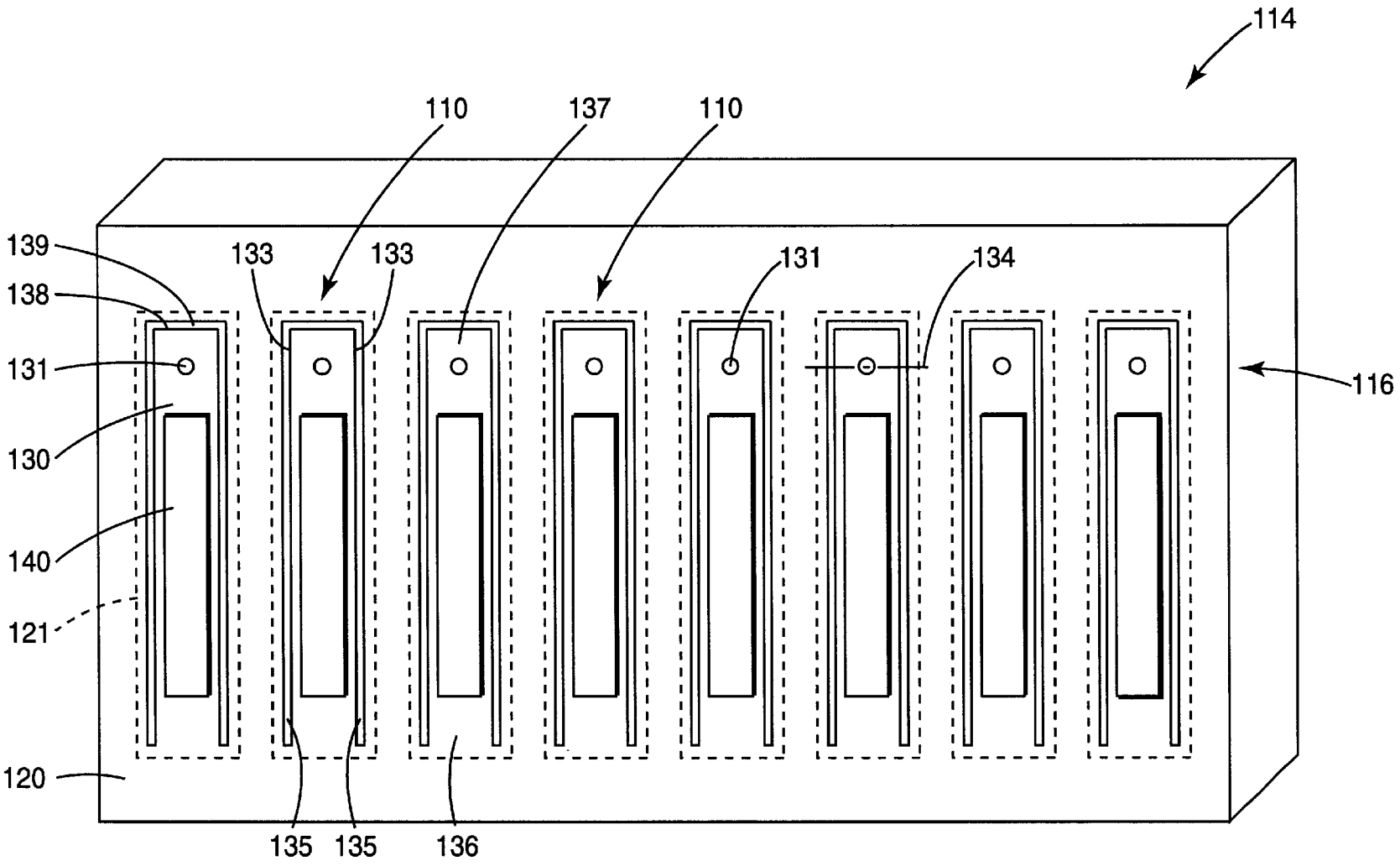
FIG. 9 is a perspective view of another embodiment of a portion of a flextensional transducer assembly according to the present invention including an array of flextensional transducers.

FIG. 9 illustrates another embodiment of flextensional transducer assembly 14. Flextensional transducer assembly 114 includes a plurality of flextensional transducers 110. Flextensional transducers 110 include a substrate 120, a flexible membrane portion 130, and an actuator 140. Substrate 120 is similar to substrate 20 of flextensional transducers 10. As such, substrate 120 includes a plurality of fluid cavities 121 similar to those described above with regard to flextensional transducers 10.

Flexible membrane portion 130 includes an orifice 131 similar to orifice 31 of flexible membrane portion 30. As such, orifice 131 forms a nozzle for ejecting a quantity of fluid from fluid cavity 121 in response to deflection of flexible membrane portion 130 in a manner similar to that described above with regard to flextensional transducers 10. In addition, flexible membrane portion 130 also includes a pair of spaced edges 133 similar to spaced edges 33 of flexible membrane portion 30. As such, in one embodiment, spaced edges 133 are formed by spaced slits 135 in a manner similar to that described above with regard to slits 35.

Flexible membrane portion 130, however, also has an edge 138 which extends between spaced edges 133. In one embodiment, edge 138 is formed by a slit 139 extending between ends of spaced slits 135 in flexible membrane portion 130. Thus, while flexible membrane portion 30 of flextensional transducers 10 is supported at both ends 36 and 37, flexible membrane portion 130 of flextensional transducers 110 is only supported at one end 136. As such, flexible membrane portion 130 of flextensional transducers 110 is cantilevered from an end of fluid cavity 121 so as to span or extend across fluid cavity 121. End 136, therefore, constitutes a supported end of flexible membrane portion 130 and end 137 constitutes a free end of flexible membrane portion 130.

Actuator 140 is associated with and causes deflection of flexible membrane portion 130. In one embodiment, actuator 140 is provided and, more specifically, mounted or formed on a side of flexible membrane portion 130 opposite fluid cavity 121. In addition, orifice 131 is provided adjacent to free end 137 of flexible membrane portion 130. As such, actuator 140 is positioned between orifice 131 and supported end 136 of flexible membrane portion 130.

When an electrical signal is applied to actuator 140, actuator 140 applies a force to flexible membrane portion 130 responsive to the electrical signal. As such, flexible membrane portion 130 deflects with maximum deflection occurring at end 137. Orifice 131, therefore, is located in an area of flexible membrane portion 130 which achieves maximum deflection. Thus, cyclical application of an electrical signal to actuator 140 causes flexible membrane portion 130 to oscillate preferably to resonance and eject droplets of fluid from orifice 131.

In one embodiment, flextensional transducers 110 of flextensional transducer assembly 114 are arranged in a linear array. As such, orifice 131 of one flextensional transducer 110 is aligned with orifice 131 of another and, more specifically, adjacent flextensional transducer 110. More specifically, axis 134 of one orifice 131 is aligned with axis 134 of an adjacent orifice 131. Thus, orifices 131 of adjacent flextensional transducers 110 form a row of orifices 116.

Figure 10:
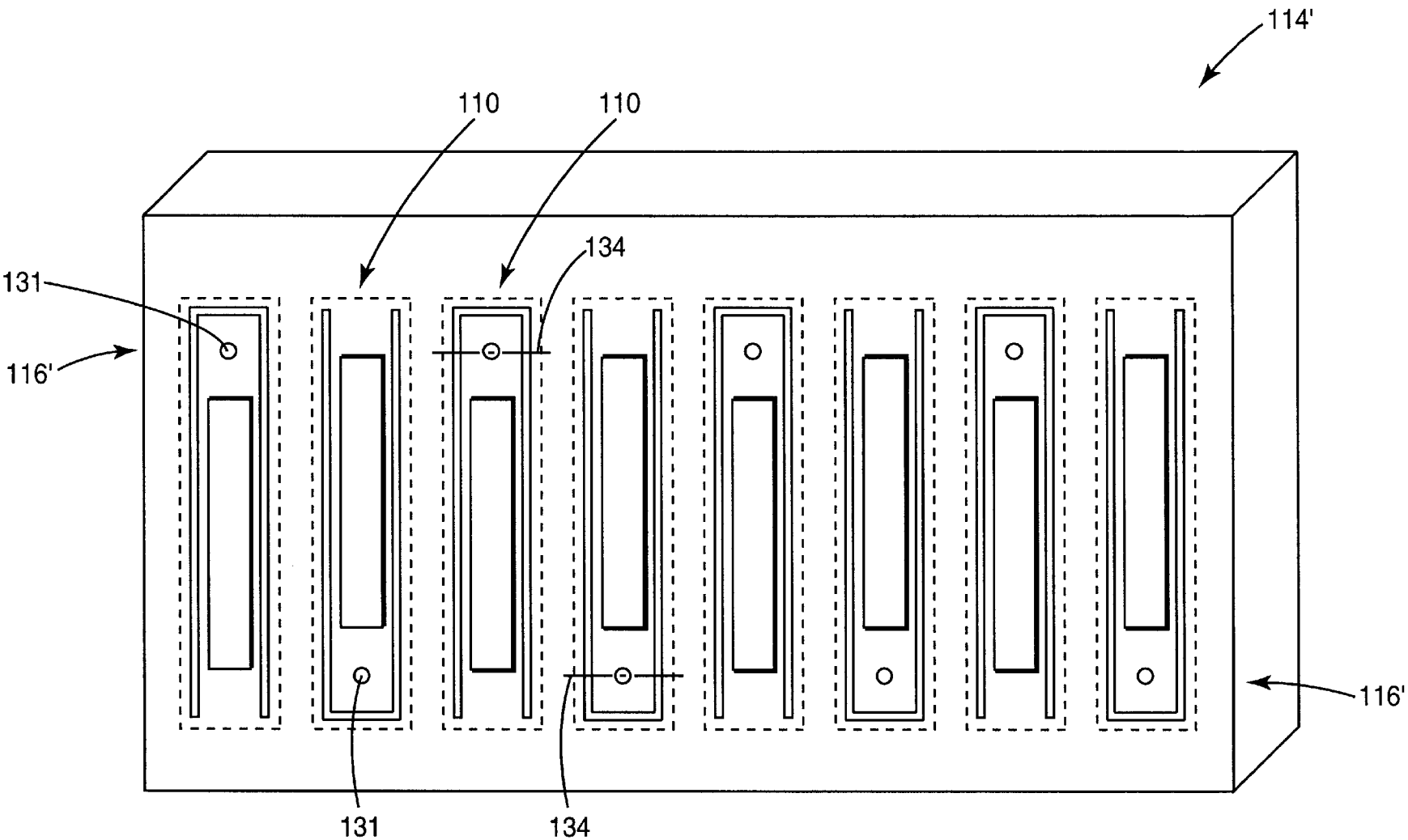
FIG. 10 is a perspective view of another embodiment of the flextensional transducer assembly of FIG. 9.

FIG. 10 illustrates another embodiment of flextensional transducer assembly 114. Flextensional transducer assembly 114' is similar to flextensional transducer assembly 114, with the exception that flextensional transducers 110 are arranged in an alternating linear array. As such, orifice 131 of one flextensional transducer 110 is offset relative to orifice 131 of another and, more specifically, adjacent flextensional transducer 110. More specifically, axis 134 of one orifice 131 is offset relative to axis 134 of an adjacent orifice 131. In one embodiment, orifices 131 of alternate flextensional transducers 110 form a row of orifices 116'.

Figure 11:
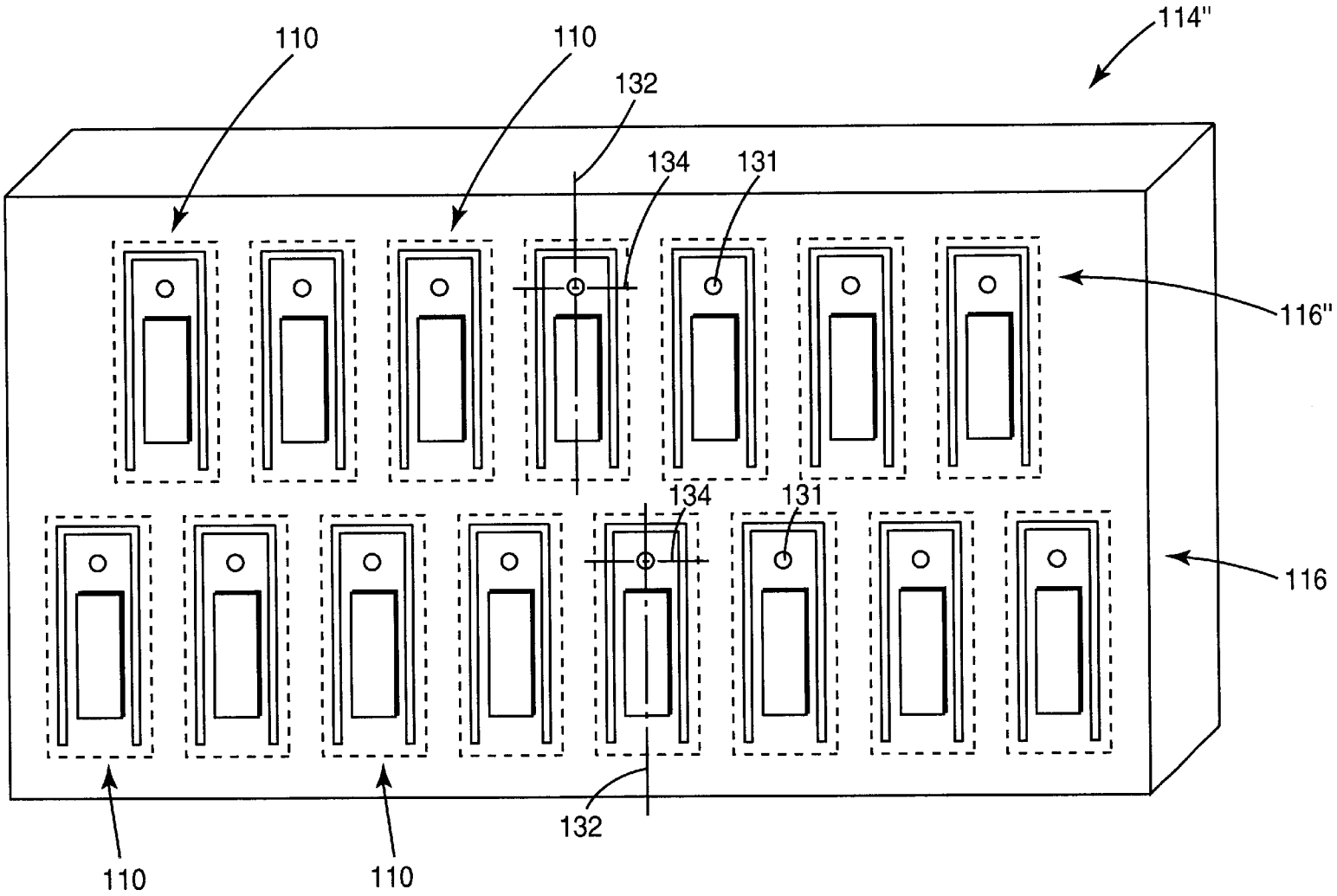
FIG. 11 is a perspective view of another embodiment of the flextensional transducer assembly of FIG. 9.

FIG. 11 illustrates another embodiment of flextensional transducer assembly 114. Flextensional transducer assembly 114" is similar to flextensional transducer assembly 114, with the exception that flextensional transducers 110 are arranged in at least two offset linear arrays. As such, orifice 131 of one flextensional transducer 110 is offset relative to orifice 131 of another flextensional transducer 110. More specifically, axis 132 of one flextensional transducer 110 of one linear array is offset relative to axis 132 of another flextensional transducer 110 of another linear array. Axis 134 of one orifice 131, however, is aligned with axis 134 of an adjacent orifice 131. In one embodiment, orifices 131 of adjacent flextensional transducers 110 form a first row of orifices 116 and orifices 131 of offset flextensional transducers 110 form a second row of orifices 116".

While the two linear arrays of flextensional transducers 110 are illustrated as being oriented in the same direction, it is within the scope of the present invention for flextensional transducers 110 to be arranged in other configurations. For example, flextensional transducers 110 forming the row of orifices 116" may be rotated 180 degrees. Thus, flextensional transducers 110 form two opposing, offset linear arrays. In addition, while two linear arrays are illustrated, the number of linear arrays formed by flextensional transducers 110 may vary.

Figure 12:
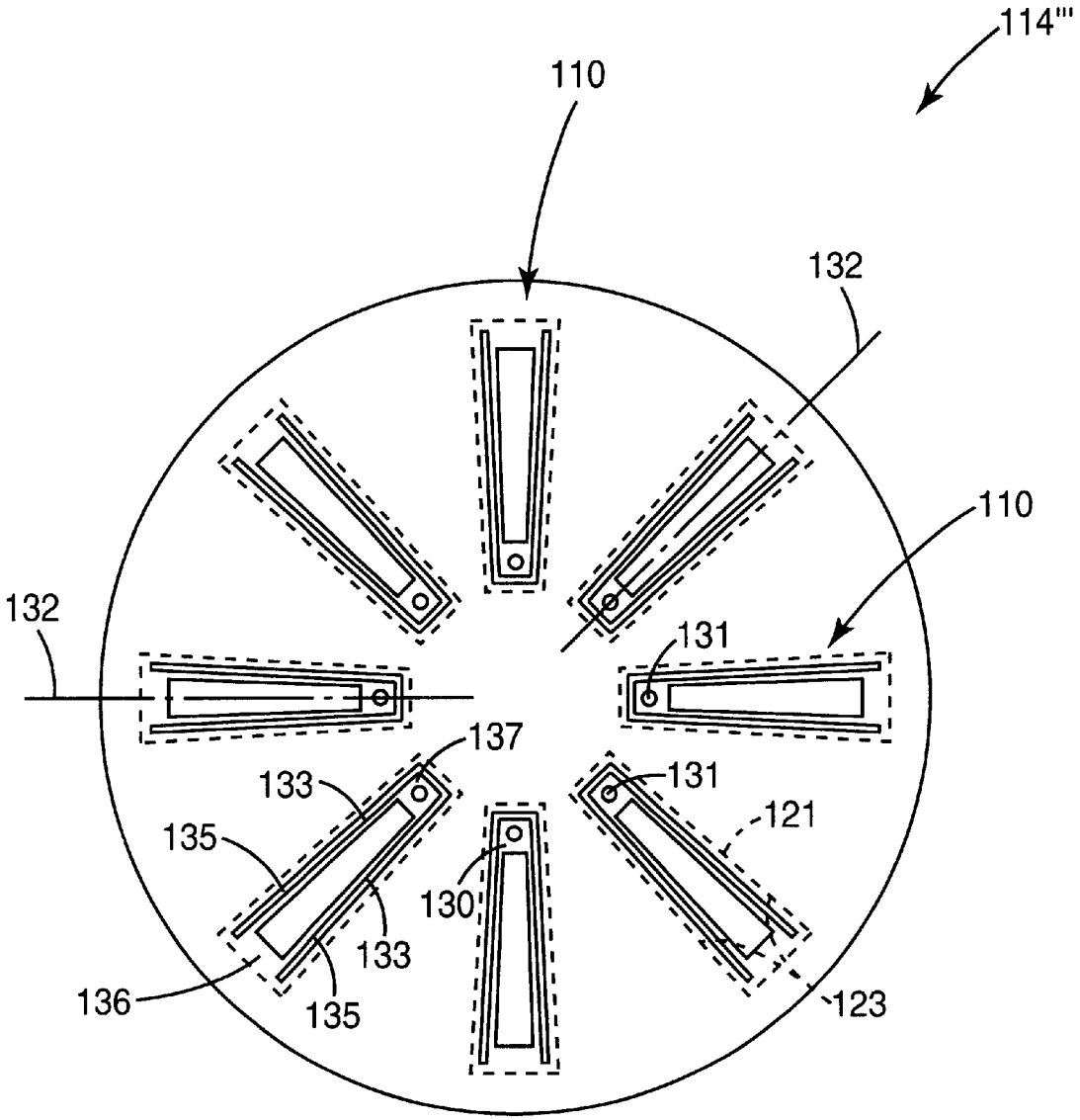
FIG. 12 is a perspective view of another embodiment of the flextensional transducer assembly of FIG. 9.

FIG. 12 illustrates another embodiment of flextensional transducer assembly 114. Flextensional transducer assembly 114'" is similar to flextensional transducer assembly 114, with the exception that flextensional transducers 110 are arranged in a radial array. As such, orifice 131 of one flextensional transducer 110 is offset and, more specifically, radially offset from orifice 131 of another flextensional transducer 110. Thus, axis 132 of one flextensional transducer 110 converges with axis 132 of another flextensional transducer 110.

In one embodiment, flextensional transducers 110 are radially symmetrical such that orifices 131 are spaced radially a predetermined distance from a common point of flextensional transducer assembly 114'". In addition, free end 137 of flexible membrane portion 130 of flextensional transducer assembly 114'" is positioned radially inward of supported end 136. While orifices 131 are illustrated as being arranged in a single radial array, it is within the scope of the present invention for orifices 131 to be arranged in other configurations including multiple, staggered, and/or offset rows. As such, orifices 131 may form a "showerhead" array of orifices.

In one embodiment, flexible membrane portion 130 of flextensional transducer 110 of flextensional transducer assembly 114'" is tapered such that free end 137 is narrower than supported end 136. Thus, spaced edges 133 of flexible membrane portion 130 and, therefore, spaced slits 135 converge toward a common point of flextensional transducer assembly 114'". In addition, opposing sides 123 of fluid cavity 121 are tapered. Spaced edges 133 of flexible membrane portion 130, therefore, track opposing sides 123 of fluid cavity 121.

Figure 13:
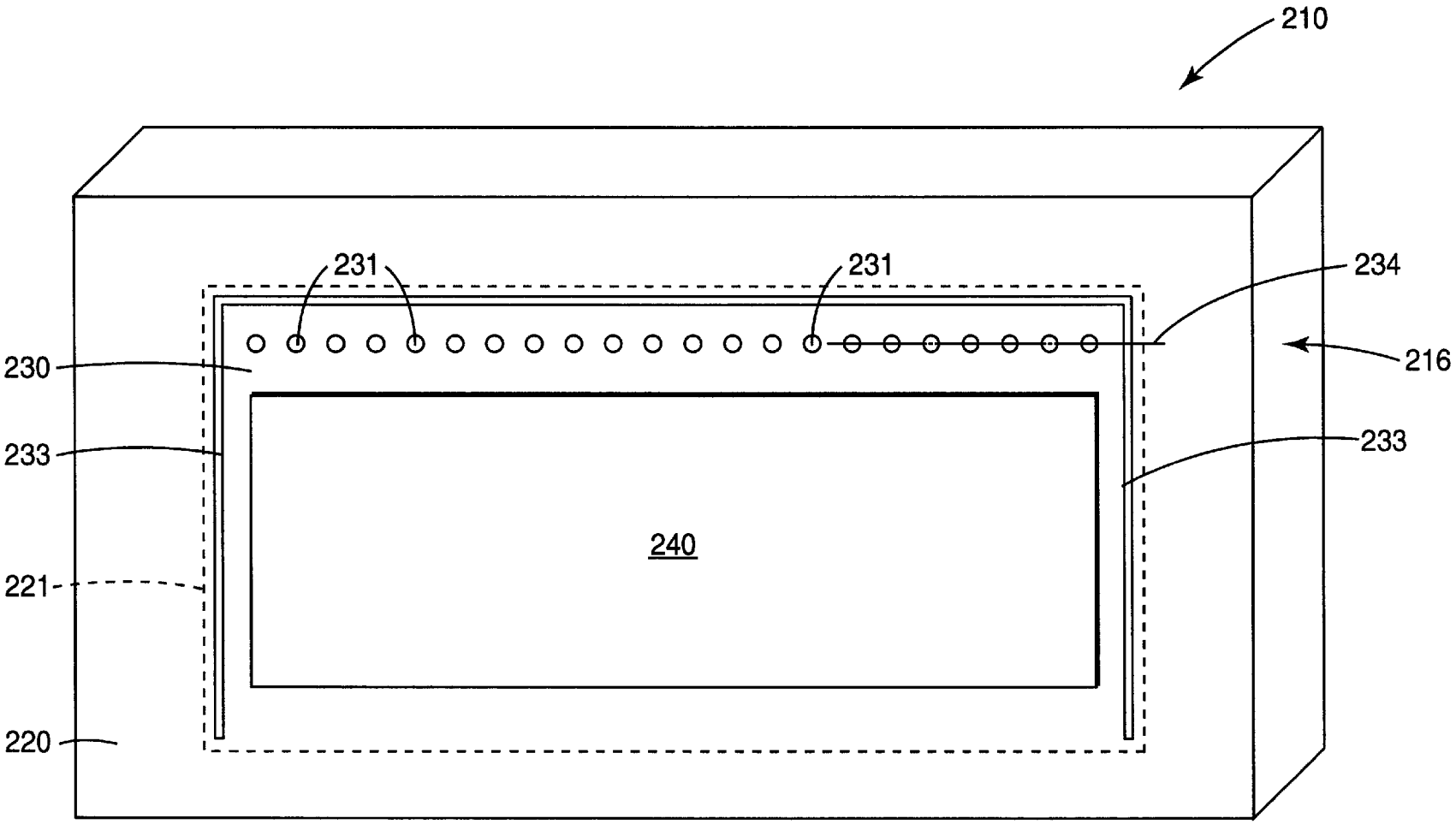
FIG. 13 is a perspective view of another embodiment of a portion of a flextensional transducer assembly according to the present invention.

FIG. 13 illustrates another embodiment of flextensional transducer 110. Flextensional transducer 210 includes a substrate 220, a flexible membrane portion 230, and an actuator 240. Substrate 220, flexible membrane portion 230, and actuator 240 are similar to substrate 120, flexible membrane portion 130, and actuator 140, respectively, of flextensional transducers 110, with the exception that flexible membrane portion 230 has a plurality of orifices 231 formed therein. Thus, deflection of flexible membrane portion 230 by actuator 240 simultaneously generates a plurality of droplets.

In one embodiment, orifices 231 are aligned along an axis 234 oriented substantially perpendicular to spaced edges 233 of flexible membrane portion 230. As such, orifices 231 form a row of orifices 216 which is located in an area of flexible membrane portion 230 which achieves maximum deflection. While orifices 231 are illustrated as being aligned along axis 234, it is within the scope of the present invention for orifices 231 to be arranged in other configurations including multiple, staggered, and/or offset rows. In addition, it is understood that the number of orifices 231 formed in flexible membrane portion 230 may vary.

Figure 14:
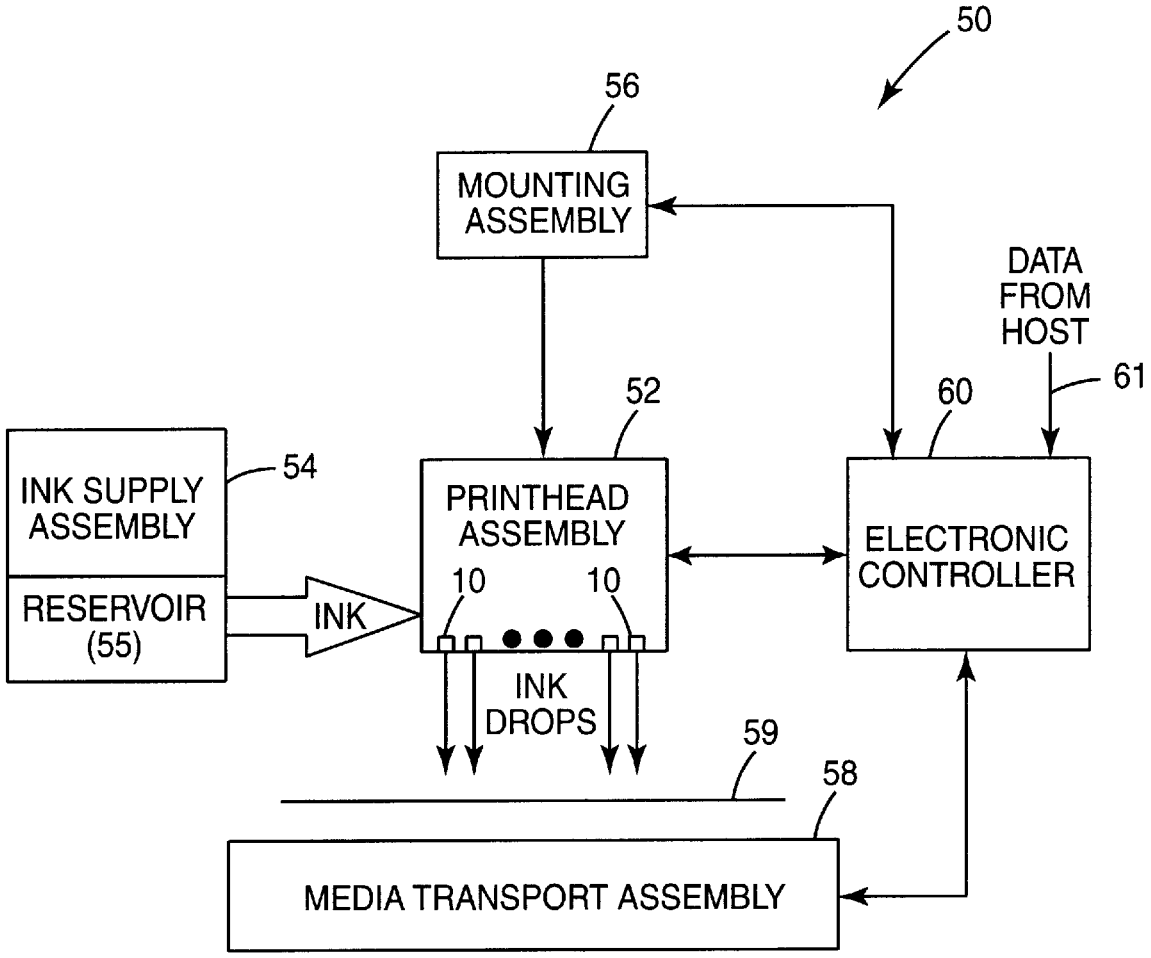
FIG. 14 is a block diagram illustrating one embodiment of an inkjet printing system including a plurality of flextensional transducers according to the present invention.

FIG. 14 illustrates one embodiment of an inkjet printing system 50 according to the present invention. Inkjet printing system 50 includes an inkjet printhead assembly 52, an ink supply assembly 54, a mounting assembly 56, a media transport assembly 58, and an electronic controller 60. Inkjet printhead assembly 52 includes one or more printheads each including a plurality of flextensional transducers 10, 110, or 210 which eject drops of ink onto a print medium 59. Print medium 59 is any type of suitable sheet material, such as paper, card stock, transparencies, and the like.

Typically, flextensional transducers 10, 110, or 210 are arranged in one or more columns or arrays. As such, properly sequenced ejection of ink from flextensional transducers 10, 110, or 210 causes characters, symbols, and/or other graphics or images to be printed upon print medium 59 as inkjet printhead assembly 52 and print medium 59 are moved relative to each other. In one embodiment, individual flextensional transducers 10, 110, or 210 may be provided for ejection of fluids with different properties such as inks of different colors.

Ink supply assembly 54 supplies ink to inkjet printhead assembly 52 and includes a reservoir 55 for storing ink. As such, ink flows from reservoir 55 to inkjet printhead assembly 52 and, more specifically, to fluid reservoir 24 of flextensional transducers 10, 110, or 210. In one embodiment, inkjet printhead assembly 52 and ink supply assembly 54 are housed together in an inkjet cartridge or pen. In another embodiment, ink supply assembly 54 is separate from inkjet printhead assembly 52 and supplies ink to inkjet printhead assembly 52 through an interface connection, such as a supply tube. In either embodiment, reservoir 55 of ink supply assembly 54 may be removed, replaced, and/or refilled.

In one embodiment, where inkjet printhead assembly 52 and ink supply assembly 54 are housed together in an inkjet cartridge, reservoir 55 includes a local reservoir located within the cartridge as well as a larger reservoir located separately from the cartridge. As such, the separate, larger reservoir serves to refill the local reservoir. Accordingly, the separate, larger reservoir and/or the local reservoir may be removed, replaced, and/or refilled.

Mounting assembly 56 positions inkjet printhead assembly 52 relative to media transport assembly 58 and media transport assembly 58 positions print medium 59 relative to inkjet printhead assembly 52. In one embodiment, inkjet printhead assembly 52 is a scanning type printhead assembly. As such, mounting assembly 56 includes a carriage for moving inkjet printhead assembly 52 relative to media transport assembly 58 to scan print medium 59. In another embodiment, inkjet printhead assembly 52 is a non-scanning type printhead assembly. As such, mounting assembly 56 fixes inkjet printhead assembly 52 at a prescribed position relative to media transport assembly 58. Thus, media transport assembly 58 positions print medium 59 relative to inkjet printhead assembly 52.

Electronic controller 60 communicates with inkjet printhead assembly 52, mounting assembly 56, and media transport assembly 58. Electronic controller 60 receives data 61 from a host system, such as a computer, and includes memory for temporarily storing data 61. Typically, data 61 is sent to inkjet printing system 50 along an electronic, infrared, optical or other information transfer path. Data 61 represents, for example, a document and/or file to be printed. As such, data 61 forms a print job for inkjet printing system 50 and includes one or more print job commands and/or command parameters.

In one embodiment, electronic controller 60 provides control of inkjet printhead assembly 52 including timing control for ejection of ink drops from flextensional transducers 10, 110, or 210. As such, electronic controller 60 defines a pattern of ejected ink drops which form characters, symbols, and/or other graphics or images on print medium 59. Timing control and, therefore, the pattern of ejected ink drops, is determined by the print job commands and/or command parameters.

While the above description refers to inclusion of flextensional transducers 10 in an inkjet printing system 50, it is understood that flextensional transducers 10 may be incorporated into other fluid ejection systems including non-printing applications or systems such as a medical nebulizer. In addition, while the above description refers to ejection of fluid or ink from flextensional transducers 10, it is understood that any flowable material, including a liquid such as photoresist or flowable particles such as talcum powder, may be ejected from flextensional transducers 10.

By forming flexible membrane portion 30 of flextensional transducers 10 with spaced edges 33, flextensional transducers 10 can be arranged in compact arrays. More specifically, flextensional transducers 10 and, therefore, orifices 31 can be more closely arranged than conventional flextensional transducers 90. Thus, a density of orifices 31 of a plurality of flextensional transducers 10 can be increased while maintaining the same drop volume and drop velocity. As such, with flextensional transducer assembly 14, a total volume of ejected fluid can be increased.

In addition, by providing spaced slits 35 in flexible membrane portion 30 of flextensional transducers 10, flexible membrane portion 30 is supported or clamped on less than all sides. As such, flexible membrane portion 30 is more flexible than circular flexible membrane 94 of the conventional flextensional transducer 90. Thus, greater displacement of flexible membrane portion 30 relative to substrate 20 and, therefore, a higher velocity of ejection of droplets through orifice 31 of flexible membrane portion 30 is permitted. For the same drop volume, drop velocity, and amount of force applied by actuator 40, however, flexible membrane portion 30 may be made smaller than circular flexible membrane 94 of the conventional flextensional transducer 90. Thus, flextensional transducers 10 and, therefore, flextensional transducer assembly 14 may be made smaller. More nozzles 31, therefore, may be provided per unit area of flextensional transducer assembly 14.

By supporting or clamping flexible membrane portion 30 only at ends 36 and/or 37 rather than along an entire circumferential edge, as required by circular flexible membrane 94 of the conventional flextensional transducer 90, flextensional transducers 10 provide greater flexibility in design. Flextensional transducers 10, for example, offer an extra degree of freedom. More specifically, flexible membrane portion 30 has degrees of freedom in x and y directions while circular flexible membrane 94 only has a degree of freedom in a radial direction. As such, flextensional transducers 10 impose fewer design constraints. Thus, flextensional transducers 10 provide more control over design criteria such as linear or areal density, frequency, drop size, drop velocity, etc.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the chemical, mechanical, electro-mechanical, electrical, and computer arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. A flextensional transducer, comprising:

a substrate having a fluid cavity defined therein;

a flexible membrane portion supported by the substrate and having a pair of spaced edges and an orifice defined therein which communicates with the fluid cavity; and an actuator associated with the flexible membrane portion, wherein the actuator is adapted to deflect the flexible membrane portion in response to an electrical signal.

2. The flextensional transducer of claim 1, wherein the fluid cavity is adapted to hold a supply of fluid therein, wherein the fluid communicates with the orifice of the flexible membrane portion.

3. The flextensional transducer of claim 2, wherein the orifice of the flexible membrane portion defines a nozzle adapted to eject a quantity of the fluid in response to deflection of the flexible membrane portion.

4. The flextensional transducer of claim 1, wherein the pair of spaced edges of the flexible membrane portion are substantially linear.

5. The flextensional transducer of claim 1, wherein the pair of spaced edges of the flexible membrane portion are curved.

6. The flextensional transducer of claim 1, wherein the fluid cavity has opposing sides, wherein the pair of spaced edges of the flexible membrane portion follow the opposing sides of the fluid cavity.

7. The flextensional transducer of claim 1, wherein the substrate includes opposing sidewalls which define opposing sides of the fluid cavity.

8. The flextensional transducer of claim 7, wherein the sidewalls of the substrate are substantially linear.

9. The flextensional transducer of claim 7, wherein the sidewalls of the substrate are curved.

10. The flextensional transducer of claim 7, wherein the pair of spaced edges of the flexible membrane portion are positioned within the sidewalls of the substrate.

11. The flextensional transducer of claim 1, wherein the pair of spaced edges of the flexible membrane portion are formed by a pair of spaced slits in the flexible membrane portion.

12. The flextensional transducer of claim 11, wherein the pair of spaced slits include spaced cuts through the flexible membrane portion.

13. The flextensional transducer of claim 11, wherein the pair of spaced slits include spaced channels in the flexible membrane portion.

14. The flextensional transducer of claim 1, wherein the flexible membrane portion has an edge extending between the pair of spaced edges thereof.

15. The flextensional transducer of claim 14, wherein the edge of the flexible membrane portion is oriented substantially perpendicular to the pair of spaced edges thereof.

16. The flextensional transducer of claim 14, wherein the edge of the flexible membrane portion is formed by a slit in the flexible membrane portion.

17. The flextensional transducer of claim 1, wherein the flexible membrane portion is cantilevered over the fluid cavity.

18. The flextensional transducer of claim 1, wherein the flexible membrane portion has a plurality of orifices defined therein.

19. The flextensional transducer of claim 1, wherein the actuator is provided on a side of the flexible membrane portion and positioned between the orifice and a supported end of the flexible membrane portion.

20. The flextensional transducer of claim 1, wherein the actuator includes a first actuator and a second actuator, and wherein the orifice is located between the first actuator and the second actuator.

21. The flextensional transducer of claim 1, wherein the actuator includes a piezoelectric material.

22. A method of forming a flextensional transducer, the method comprising the steps of:

defining a fluid cavity in a substrate;

supporting a flexible membrane portion by the substrate;

defining a pair of spaced edges of the flexible membrane portion;

communicating an orifice of the flexible membrane portion with the fluid cavity; and associating an actuator with the flexible membrane portion, wherein the actuator is adapted to deflect the flexible membrane portion in response to an electrical signal.

23. The method of claim 22, wherein the step of supporting the flexible membrane portion includes extending the flexible membrane portion across the fluid cavity.

24. The method of claim 22, wherein the step of supporting the flexible membrane portion includes supporting at least one end of the flexible membrane portion by the substrate.

25. The method of claim 22, wherein the step of defining the pair of spaced edges of the flexible membrane portion includes positioning the pair of spaced edges of the flexible membrane portion within sidewalls of the fluid cavity.

26. The method of claim 22, wherein the step of defining the pair of spaced edges of the flexible membrane portion includes forming a pair of spaced slits in the flexible membrane portion.

27. The method of claim 26, wherein forming the pair of spaced slits in the flexible membrane portion includes forming a pair of spaced cuts through the flexible membrane portion.

28. The method of claim 26, wherein forming the pair of spaced slits in the flexible membrane portion includes forming a pair of spaced channels in the flexible membrane portion.

29. The method of claim 22, wherein the step of associating the actuator with the flexible membrane portion includes providing the actuator on a side of the flexible membrane portion.

30. A method of ejecting droplets of a fluid, the method comprising the steps of:

supplying a fluid cavity with the fluid;

extending a flexible membrane portion having a pair of spaced edges and an orifice defined therein over the fluid cavity such that the orifice communicates with the fluid cavity; and deflecting the flexible membrane portion relative to the fluid cavity to eject a quantity of the fluid through the orifice of the flexible membrane portion when the flexible membrane portion deflects.

31. The method of claim 30, wherein the step of deflecting the flexible membrane portion includes deflecting the flexible membrane portion with an actuator provided on a side of the flexible membrane portion.

32. The method of claim 31, wherein the step of deflecting the flexible membrane portion includes applying an electrical signal to the actuator.

33. A flextensional transducer, comprising:

a substrate having a fluid cavity defined therein;

a flexible membrane portion supported by the substrate and having an orifice defined therein which communicates with the fluid cavity;

an actuator associated with the flexible membrane portion, wherein the actuator is adapted to deflect the flexible membrane portion in response to an electrical signal; and a compliant feature adjacent the actuator, wherein the compliant feature facilitates deflection of the flexible membrane portion.

34. The flextensional transducer of claim 33, wherein the compliant feature includes an elastic region of the flexible membrane portion.

35. The flextensional transducer of claim 33, wherein the compliant feature includes a supple region of the flexible membrane portion.

36. The flextensional transducer of claim 33, wherein the compliant feature includes at least one cut through the flexible membrane portion.

37. The flextensional transducer of claim 33, wherein the compliant feature includes at least one channel in the flexible membrane portion.

38. The flextensional transducer of claim 33, wherein the compliant feature includes at least one gap provided along an edge of the flexible membrane portion.

39. The flextensional transducer of claim 33, wherein the compliant feature includes a pair of spaced edges of the flexible membrane portion.

* * * * *